US007793630B2

(12) United States Patent
Shewell

(10) Patent No.: US 7,793,630 B2
(45) Date of Patent: Sep. 14, 2010

(54) SWITCHABLE COMPONENT FOR A VALVE DRIVE OF AN INTERNAL COMBUSTION ENGINE

(75) Inventor: Jeffrey Shewell, Clawson, MI (US)

(73) Assignee: Schaeffler KG, Herzogenaurach (DE)

( * ) Notice: Subject to any disclaimer, the term of this patent is extended or adjusted under 35 U.S.C. 154(b) by 314 days.

(21) Appl. No.: 12/109,413

(22) Filed: Apr. 25, 2008

(65) Prior Publication Data

US 2008/0264370 A1 Oct. 30, 2008

Related U.S. Application Data

(60) Provisional application No. 60/913,836, filed on Apr. 25, 2007.

(51) Int. Cl.
*F01L 1/14* (2006.01)

(52) U.S. Cl. ..... 123/90.48; 123/90.16; 123/90; 123/52; 74/569

(58) Field of Classification Search ..... 123/90.16, 123/90.48, 90.52, 90.55; 74/569
See application file for complete search history.

(56) References Cited

U.S. PATENT DOCUMENTS 6,513,470 B1 * 2/2003 Hendriksma et al. ..... 123/90.16

* cited by examiner

*Primary Examiner*—Zelalem Eshete
(74) *Attorney, Agent, or Firm*—Volpe and Koenig, P.C.

(57) ABSTRACT

A switchable component (1) for a valve train of a combustion engine is provided, such as a roller tappet, with a housing (2), in whose borehole (3) an inner element (4) runs that can move relative to the housing in the axial direction. At least one coupling element (6) is allocated to the inner element (4), wherein this coupling element, in the decoupled case, lies with its outer end (7) directly in front of an annular surface (8) between both components (2, 4) and, in the coupled case, engages in some sections with a driver surface (9) in the borehole (3) of the housing (2), and wherein, between the components (2, 4) there is a lost-motion spring element (10) forcing these components away from each other in the axial direction. As the coupling element (6) there is at least one sickle-shaped ratchet that can pivot outward and that sits at least indirectly in an opening (11) in the outer shell (5) of the inner element (4) and that is connected to the inner element (4) in an articulated way at one end (12). An annular groove is present as a driver surface (9) in the borehole (3) of the housing (2) and the coupling element (6) can pivot outward in the coupling direction via the force of a mechanical spring (13) and can pivot inwardly in the decoupling direction via hydraulic medium guided into the driver surface (9) in front of its outer end (7).

14 Claims, 2 Drawing Sheets

SWITCHABLE COMPONENT FOR A VALVE DRIVE OF AN INTERNAL COMBUSTION ENGINE

CROSS-REFERENCE TO RELATED APPLICATIONS

This application claims the benefit of U.S. Provisional Application. No. 60/913,836, filed Apr. 25, 2007, which is incorporated herein by reference as if fully set forth.

BACKGROUND

The invention relates to a switchable component for a valve train of An internal combustion engine, with a hollow-cylindrical housing, in whose borehole an inner element that moves in the axial direction relative to the housing runs with its outer shell, wherein at least one coupling part is allocated to the inner element, wherein this coupling part lies, in the decoupled case [zero or small lift], with its outer end directly in front of an annular surface between both components and engages, in the coupled case [full lift], overlapping the annular surface in some sections, with a driver surface in the borehole of the housing, and wherein, between the components there is a lost-motion spring element, which forces these components away from each other in the axial direction.

Such switchable components, for example, switchable roller tappets, which receive force on one end from a camshaft at the bottom and which act on the other end via their inner part against a push rod, are sufficiently well known to those skilled in the art and do not need to be explained in more detail at this point. Typically, their inner part has at least one coupling piston, which, for the coupling case, can be displaced outward in the radial direction into a corresponding borehole/receptacle.

In the known state of the art, one disadvantage is that this requires excess installation space in the axial direction due to the height of the piston. In addition, in the coupled case, there is only a relatively small contact surface, so that here the hertzian stress is unnecessarily increased and it can possibly lead to undesired plastic deformation during operation. In addition, machine processing of the piston-in-borehole coupling mechanism has proven to be relatively complicated and expensive.

SUMMARY

Therefore, the objective of the invention is to create a switchable component of the type noted above, in which the cited disadvantages are overcome with simple means.

According to the invention, there is at least one sickle-shaped ratchet that can move in the radial direction and that sits in an opening in the outer shell, at least indirectly in the inner element, and that is connected indirectly or directly at one end in an articulated manner to the inner element, wherein there is either an annular groove or an annular groove segment in the peripheral section of the coupling as a driver surface in the borehole of the housing and wherein the coupling part can swing outward in the coupling direction via the force of a mechanical spring element and can also swing inward in the decoupling direction by a servo mechanism, which controls for example, a hydraulic medium flow, that can be guided to the driver surface in front of an outer end of the coupling part.

Thus a switchable component is provided for a valve train of a combustion engine, in which the disadvantages noted above are overcome.

In particular, a switchable roller tappet or flat tappet, as well as also a support element, can be used as the switchable component. Optionally, the ratchet-like coupling mechanism can also be used for switchable cup tappets or other switchable valve-drive components, such as switchable finger lever systems.

Preferably, the switchable component is constructed as a component that can be deactivated, so that, in the decoupled case, the corresponding gas-exchange valve remains closed. Optionally, the coupling mechanism is also conceivable and provided for reversible variants.

Due to the proposed ratchet element that can move in the radial direction as the coupling, the overall height of the switchable component is reduced. In addition, in the coupled case, in particular, in the variant, in which several movable coupling elements are used, there is only a relatively small surface area pressure and thus component load. In addition, it is obvious that at least one coupling element, but also the entire coupling area of the switchable component, can be formed, for example, in a simple fine-blanking process or the like. In addition, fine tolerances like those in piston-in-borehole coupling solutions known from the state of the art no longer have to be taken into account, so that the production costs can be reduced.

Preferably, several ratchet-type coupling elements (e.g., two or three) are used distributed around the periphery.

It is especially advantageous when one or more ratchet-type coupling elements move outward in the coupling direction via the force of a spring, such as a hairpin valve spring or the like, and are pivoted inward in the radial direction in a decoupling direction by hydraulic medium pressure. Other elements, such as helical, spiral, torsion springs, etc. can be used as the spring. Optionally, at least one ratchet-type coupling element can be moved outward via hydraulic medium pressure and can be displaced back by a spring force. Alternatively, its two-directional displacement is also conceivable and provided by hydraulic medium pressure.

It is indeed possible for the at least one ratchet-type element to be arranged directly in an opening in the outer shell of the inner element. Preferably, however, the coupling area should have a built-up construction and thus is made from a disk-like closing plate, above which extends a support plate with at least one ratchet-type coupling element. Both components are connected by suitable attachment measures to a bottom end of the inner element. For this purpose, for example, a simple stump-like projection or the like is provided.

As simple connection of the components noted above for illustrating the coupling area, it is provided to connect at least one of the components (closing plate, support plate), for example, by a fixing process, as well as also by pressing, fusing, and the like, with the stump-like projection. Obviously, the ratchet-type coupling elements can be protected from wear accordingly by suitable heat-treatment measures and/or applied layers.

A simple connection possibility of the ratchet-type coupling elements with the inner element (at least indirectly) or with the support plate directly is also provided. Accordingly, the coupling element, which has a sickle-shaped or brake shoe-shaped geometry, has, at one end (or possibly another section), a bearing journal, which is held in a counter surface constructed as a joint socket at the opening of the support plate. Optionally, the joint socket can also be constructed on the coupling element and the corresponding counter surface can be provided in the support plate. It is also conceivable and provided, however, to provide a pin-mounting eye connection or the like in this area. Optionally, it is also conceivable and provided to not pivot the ratchet-type coupling elements outward in the radial direction, but instead to simply "shift" it outward in the radial direction.

To allow simple draining of excess hydraulic medium, the closing plate has perforations, such as boreholes/punch-outs.

As provided according to one aspect of the invention, the driver surface in the borehole of the housing for the ratchet-type0 coupling elements should preferably be formed as an annular groove or annular groove segment. In the case of annular groove segments, it must be guaranteed that each segment has a corresponding supply of the hydraulic medium. Alternatively, the borehole of the housing can also have corresponding projections or the like, in or under which the corresponding coupling element engages in the coupled case.

BRIEF DESCRIPTION OF THE DRAWINGS

The invention is preferably explained in more detail with reference to the drawing. Shown are.

DETAILED DESCRIPTION OF THE PREFERRED EMBODIMENTS

Figure 1:
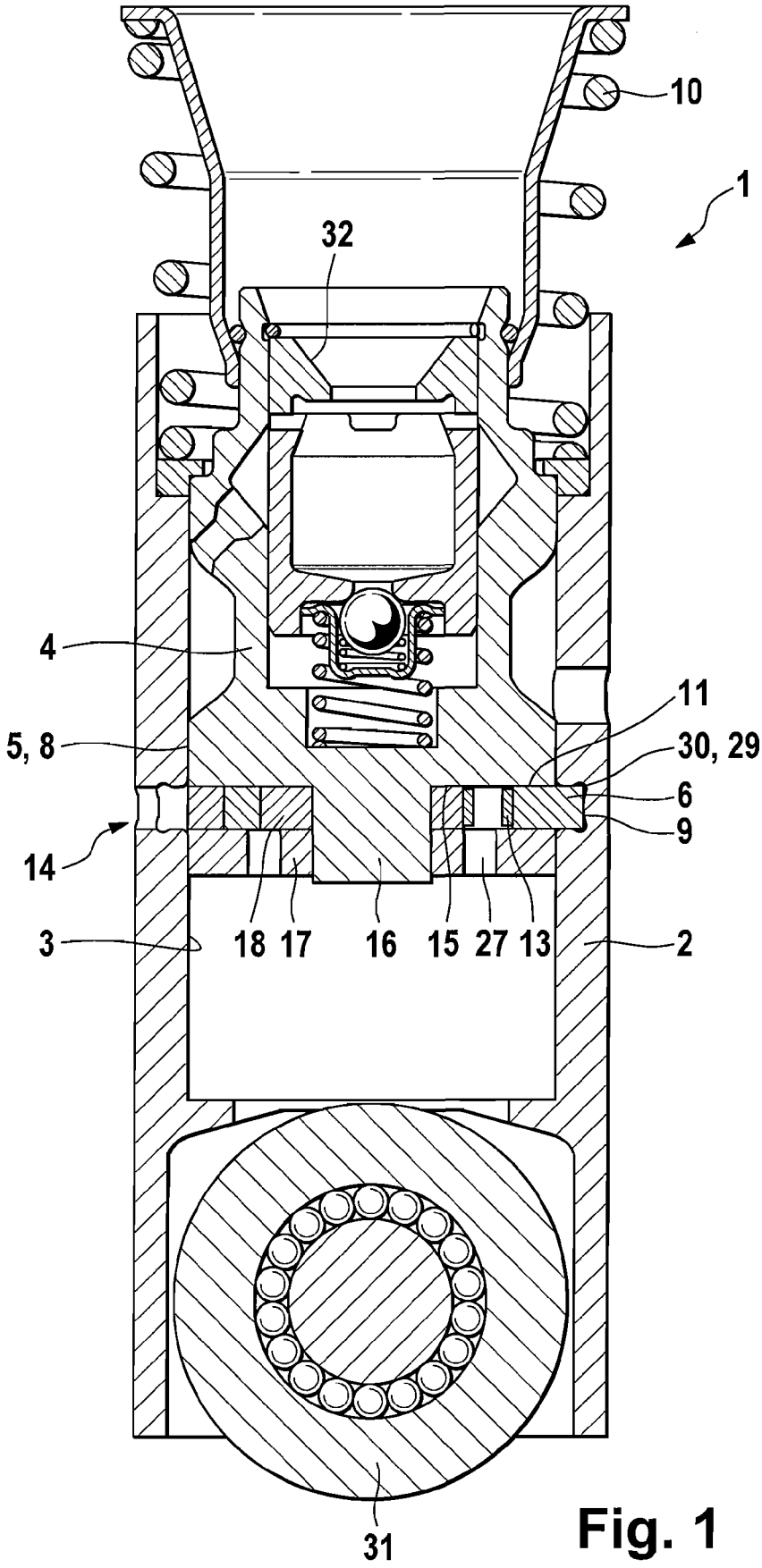
FIG. 1 is a longitudinal section view through a switchable component constructed as a roller tappet.
Figure 2:
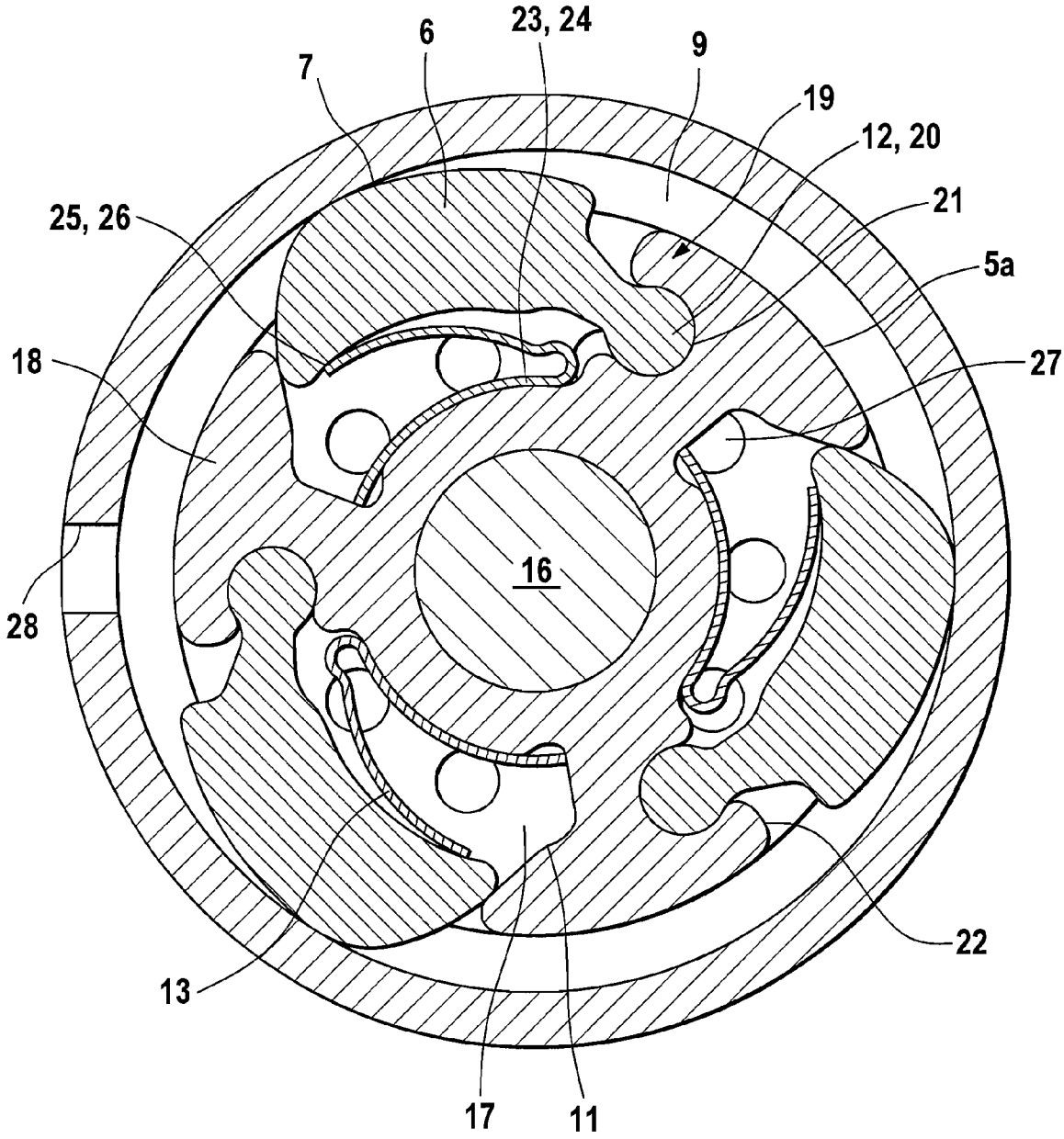
FIG. 2 is a cross-sectional view through the switchable component according to FIG. 1 in the area of its coupling section.

A switchable component 1 for a valve train of a combustion engine is shown. This is formed as a switchable roller tappet. The component 1 has a hollow cylindrical housing 2 having a borehole 3 in which an inner element 4 is held so that it can move in the axial direction. The housing 2 has a cam contact surface 31 formed as a roller on a bottom side. On the opposite side, the inner element 4 has a support 32 for at least one tappet push rod. In addition, it can be seen that, in the interior of the inner element 4, a hydraulic lash-compensating device is provided with a known construction.

In an area of a bottom end 15, the inner element 4 has a stump-like projection 16. A closing plate 17 is arranged on this projection 16, for example, through a fixed connection. The closing plate 17 has perforations 27 distributed on the periphery for unimpaired discharge of hydraulic medium (see below). On the closing plate 17, similarly mounted on the projection 16, there is a support plate 18. This has three openings 11 distributed about its periphery. Each opening 11 has, on one side surface 22, a formation that provides a joint socket 21. In the corresponding joint socket 21, a coupling element 6 formed as a ratchet that can pivot outward in the radial direction is held in an articulated manner by a bearing journal 20 extending from its end 12.

A spring 13, which is here provided as a hairpin valve spring (bending spring), acts against an inner end 26 of the corresponding coupling element 6. This spring 13 acts with an outer leg 25 against an inner end 26 of the corresponding coupling element 6 and with an inner leg 25 against a corresponding base 24 of the respective opening 11 in the support plate 18.

As to be seen, the openings 11 extend from an outer shell 5*a* of the support plate 18. Optionally, the openings 11 can also run directly in the outer shell 5 of the inner element 4, so that, here, the "built-up" variant of the coupling area can also be eliminated.

The coupling state of the coupling elements 6 is disclosed. Here, a corresponding driver surface 9 is provided in the borehole 3 of the housing 2. This is constructed as a peripheral annular groove. For displacing the coupling elements 6 in a decoupling direction (pivoting inward in the corresponding opening 11), hydraulic medium pressure is used. For this purpose, the housing 2 has at least one borehole as a radial passage 28. The hydraulic medium is thus led in the desired decoupled case via the radial borehole 28 to the driver surface 9 and in front of the outer ends 7 of the coupling elements 6 in the radial direction. To guarantee good, all-encompassing distribution of the hydraulic medium in the driver surface 9, a base 29 of the driver surface 9 is formed with two annular circumferential recesses 30 spaced apart from each other in the axial direction.

Coupling/decoupling takes place in the cam reference circle area. If the decoupled state of the switchable component 1 caused by hydraulic medium pressure is to be lifted, in which the coupling elements 6 are disengaged from the driver surface 9 and into their openings 11, then the previously mentioned hydraulic medium pressure is largely canceled and the ratchet-type coupling elements are pivoted outward in the radial direction in the driver surface 9 by the force of the spring 13.

It is especially simple in terms of production when the components of the coupling area (coupling means 6, closing plate 17, support plate 18) are formed in a simple fine-blanking process.

In an embodiment of the invention, in which the switchable component 1 is formed as a support element, the housing 2 is arranged with its outer shell in a receptacle of the combustion engine and the inner element 4 has in the area of its bearing 32 a head, on which a finger lever type cam follower is supported on one end.

LIST OF REFERENCE SYMBOLS

1) Component
2) Housing
3) Borehole of housing
4) Inner element
5) Outer shell of inner element
5*a*) Outer shell of support plate
6) Coupling element
7) Outer end of coupling element
8) Annular surface
9) Driver surface
10) Lost-motion spring
11) Opening
12) End
13) Spring
14) Coupling area
15) End
16) Projection
17) Closing plate
18) Support plate
19) Connection
20) Bearing journal
21) Joint socket
22) Side surface
23) Leg
24) Base of opening
25) Leg
26) Inner end
27) Perforation
28) Radial passage
29) Base
30) Peripheral recess
31) Cam contact surface (roller)
32) Support

The invention claimed is:

1. Switchable component for a valve train of an internal combustion engine, the switchable component comprising a hollow-cylindrical housing, having a borehole, an inner element having an outer shell that is moveable in an axial direction relative to the housing positioned in the borehole, at least one coupling element allocated to the inner element, the at least one coupling element is movable from a decoupled state for a zero or small lift, in which an outer end of the coupling element lies directly in front of an annular surface between the two hollow-cylindrical housing and the inner element and, in a coupled state for a full lift, engages, to overlap the annular surface in the borehole of the housing in some sections, with a driver surface in the housing, and a lost-motion spring is located between the housing and the inner element for forcing the housing and the inner element away from each other in the axial direction, the at least one coupling element comprises at least one sickle-shaped ratchet that can pivot outward in a radial direction and sits at least indirectly in an opening in the outer shell of the inner element and is connected indirectly or directly at one end in an articulated manner to the inner element, the driver surface in the borehole of the housing comprises either an annular groove or an annular groove segment that is provided in a circumferential section of a coupling area and the at least one coupling element can pivot outward in a coupling direction via a force of a mechanical spring and can also pivot inwardly in a decoupling direction, and a hydraulic medium is guided along the driver surface in front of an outer end of the at least one coupling element.

2. Component according to claim 1, wherein a coupling area of the inner element comprises multiple parts.

3. Component according to claim 2, wherein the multiple parts of the coupling area of the inner element include an attachment element on a borehole-side end of the inner element formed as a stump-like projection, on which a disk-like closing plate is mounted, and a support plate is also mounted on the stump-like projection and includes the opening extending from the outer shell, with the at least one coupling element running in the opening, the support plate is installed in the axial direction between the borehole-side end and the closing plate.

4. Component according to claim 3, wherein the at least one coupling element is mounted on one end so that it can pivot at least indirectly relative to the inner element by a bearing journal pivot socket or by a pin-mounting eye connection.

5. Component according to claim 4, wherein, the bearing journal pivot socket is provided, and the at least one coupling element includes a bearing journal on one end, and a joint socket is formed in a bordering side surface of the opening of the support plate.

6. Component according to claim 1, wherein the spring comprises a mechanical spring having one leg that acts against a base of the opening and having an other leg that acts against an inner end of the at least one coupling element.

7. Component according to claim 1, wherein there are exactly two diametrically opposite coupling elements.

8. Component according to claim 1, wherein there are at least three coupling elements distributed equally around a periphery of the inner element.

9. Component according to claim 3, wherein at least one of the closing plate or the support plate is connected by an attachment to the stump-like projection of the inner element which comprises one of fixing, fusing, pressing or shrinking.

10. Component according to claim 3, wherein at least one of the support plate, the closing plate, or the at least one coupling element, is produced by a fine-blanking process.

11. Component according to claim 3, wherein the closing plate is provided with perforations.

12. Component according to claim 1, wherein the annular groove or the annular groove segment that acts as the driver surface has at least one radial passage for the hydraulic medium, and at least one of the outer end of the coupling element or a base of the annular groove or the annular groove segment includes one or more peripheral recesses for the passage of the hydraulic medium.

13. Component according to claim 1, wherein the component is formed comprises tappet that can be deactivated.

14. Component according to claim 1, wherein the component comprises a support element that can be deactivated for a lever-type cam follower.

* * * * *